US007246873B2

(12) United States Patent
Tsuchii

(10) Patent No.: US 7,246,873 B2
(45) Date of Patent: Jul. 24, 2007

(54) RECORDING HEAD AND RECORDING APPARATUS

(75) Inventor: Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 11/202,103

(22) Filed: Aug. 12, 2005

(65) Prior Publication Data

US 2006/0044350 A1 Mar. 2, 2006

(30) Foreign Application Priority Data

Aug. 25, 2004 (JP) ..... 2004-245370

(51) Int. Cl.
*B41J 2/165* (2006.01)
*B41J 2/015* (2006.01)

(52) U.S. Cl. ..... 347/22; 347/20; 347/21; 347/29; 347/85

(58) Field of Classification Search ..... 347/6, 347/7, 21, 22, 23, 29, 30, 35, 47, 84, 85, 347/95, 100, 28, 89
See application file for complete search history.

(56) References Cited

U.S. PATENT DOCUMENTS 5,489,928 A * 2/1996 Takahashi et al. ..... 347/45
5,877,788 A * 3/1999 Haan et al. ..... 347/28
5,929,877 A * 7/1999 Hetzer et al. ..... 347/28
5,949,454 A * 9/1999 Nozawa et al. ..... 347/45
6,293,648 B1 * 9/2001 Anderson ..... 347/29
6,578,947 B1 * 6/2003 Suwabe et al. ..... 347/29
2005/0168517 A1 * 8/2005 Usuda ..... 347/29
2005/0200676 A1 * 9/2005 Kadomatsu et al. ..... 347/102
2006/0119663 A1 6/2006 Tsuchii

FOREIGN PATENT DOCUMENTS

JP 2001018408 * 1/2001
JP 2001158106 * 6/2001
JP 2002-331678 11/2002

* cited by examiner

*Primary Examiner*—Matthew Luu
*Assistant Examiner*—Joshua M Dubnow
(74) *Attorney, Agent, or Firm*—Fitzpatrick, Cella, Harper & Scinto

(57) ABSTRACT

A recording head has a channel forming member and an element substrate. A discharge port through which liquid is discharged is formed in the channel forming member. An energy generating element for discharging the liquid is formed in the substrate. A gap forming member is arranged above the channel forming member. A moisture retention liquid retention portion which retains moisture in the vicinity of the discharge port is formed between the gap forming member and the channel forming member so as to be opened toward the discharge port side. Even if the state in which the liquid is not discharged continues, the liquid in the discharge port can be prevented from drying with the recording head having the above configuration.

11 Claims, 9 Drawing Sheets

51

52

RECORDING HEAD AND RECORDING APPARATUS

BACKGROUND OF THE INVENTION

1. Field of the Invention

The present invention relates to a recording head and recording apparatus performing recording in a recording medium by discharging liquid, particularly to the recording head and recording apparatus having a structure in which clogging of a discharge port is prevented by keeping a periphery of the discharge port moist.

2. Related Background Art

In a liquid discharge recording head and a liquid discharge recording apparatus on which the liquid discharge recording head is mounted (hereinafter simply referred to as "recording head" and "recording apparatus" respectively), there are various problems caused by ink (liquid) drying.

For example, when a period during which the ink is not discharged becomes longer, moisture in the ink evaporates through the discharge port, which sometimes results in an increase in viscosity of the ink in the discharge port or formation of a solid-state-like film on a surface of a meniscus in the discharge port. Thus, when the increase in viscosity of the ink or the formation of the film occurs, flow resistance of the ink is increased. Therefore, in discharge action, there are problems that discharge speed is decreased and an ink discharge direction is inclined from a predetermined direction by the influence of the solid-state-like film.

Sometimes the problem in the discharge action, which is caused by the ink drying because the ink is not discharged for a long time, is called "first discharge problem." Particularly the problem becomes easily prominent in the current recording head in which the discharge port and an ink droplet are miniaturized in order to improve image quality.

Conventionally, countermeasures are taken against the problem by forming a configuration shown in FIGS. 5A, 5B, 6A, and 6B. FIG. 5A is a top view showing the conventional recording head, and FIG. 5B is a sectional view taken along a line VB of FIG. 5A.

The recording head, in which a region where a hydrophilic process is performed to a discharge port surface is formed, is disclosed in Japanese Patent Application Laid-Open No. 2002-331678 like a recording head 150 of FIG. 5B. In the recording head 150 of FIG. 5B, a hydrophilic process portion 115 in which the hydrophilic process is performed is partially formed in the surface (discharge port surface) of a channel forming member provided as an orifice plate. As shown in the top view of FIG. 5A, the hydrophilic process portions 115 are arranged so as to be located on both sides of a discharge port row formed by plural discharge ports 107.

When the recording head 150 having the above configuration is used by mounting the recording head 150 on the well-known recording apparatus including a suction recovery mechanism of the recording head, in performing suction recovery action, the ink remains while kept in the hydrophilic process portion 115. Then, the liquid (ink) 114 kept in the hydrophilic process portion 115 gradually evaporates, which allows high humidity to be maintained near the discharge port 107. Accordingly, the ink evaporation from the discharge port 107 is suppressed, and the period can be lengthened until the problem of the discharge action occurs. Namely, the period can be lengthened until the first discharge problem (also referred to as "first discharge time") occurs.

Then, a recording head 250 of FIG. 6B will be described. FIG. 6A is a top view showing the recording head, and FIG. 6B is a sectional view taken along a line VIB of FIG. 6A.

In the recording head 250, liquid keeping grooves 205*a* are formed near a discharge port 207 such that a channel forming member 205 is bored. The liquid keeping groove 205*a* is opened toward the upper surface side. Moisture retention liquid such as the ink is kept in the liquid keeping groove 205*a* while being in the liquid state. The humidity is kept high near the discharge port 207 by the evaporation of the moisture retention liquid.

However, in the configuration shown in FIGS. 5A and 5B, the problems are generated as described below.

(1) Because an area of the hydrophilic process portion 115 is larger when compared with an amount of liquid kept in the hydrophilic process portion 115, evaporation speed of the kept liquid is fast. Therefore, it is difficult that the high humidity is kept for a long time in a periphery of the discharge port.

(2) When the surface of the channel forming member 105 is wiped with a wiping member, the liquid kept in the hydrophilic process portion 115 is also wiped. Therefore, the effect by the hydrophilic process portion 115 is not obtained.

With reference to the problem (1), the improvement can be achieved somewhat by increasing the area of the hydrophilic process portion 115. However, the recording head is enlarged, and a degree of improvement effect is not so large.

Further, in the configuration shown in FIGS. 6A and 6B, the problem is generated as described below.

(3) The liquid keeping grooves 205*a* are formed such that the channel forming member 205 is bored. Accordingly, a depth of the liquid keeping groove 205*a* is limited to a thickness of the channel forming member 205. As a result, the amount of liquid kept in the liquid keeping groove 205*a* cannot be increased to a sufficient extent. This means that the period is short until the liquid in the liquid keeping groove 205*a* evaporates completely. Consequently, it is difficult that the high humidity is kept for a long time in the periphery of the discharge port.

On the other hand, the number of liquid keeping grooves 205*a* is increased and the opening of one liquid keeping groove 205*a* is widened, which results in the sight improvement of the problem. However, there is a possibility that the improvement leads to the problem of the enlargement of the recording head. Further, even if the number of grooves is increased or the opening is widened, because the opening is separated away from the periphery of the discharge port, it is not expected that the improvement effect is sufficient.

SUMMARY OF THE INVENTION

An object of the invention is to provide a recording head and a recording apparatus which can prevent the drying of the liquid in the discharge port for a long time even if the liquid discharge continues.

In order to achieve the object, a recording head according to the invention includes an energy generating element which generates energy utilized in order to discharge liquid; a flow path (channel) forming member which has a discharge port surface, a discharge port which discharges the liquid is provided in the discharge port surface, the channel forming member being communicated with the discharge port; and a gap forming member which faces the discharge port surface, the gap forming member being arranged such that a gap is provided between the discharge port surface and the gap forming member except for a position corresponding to the discharge port, wherein the gap is communicated with an opening portion which is opened toward a direction of the discharge port, and moisture retention liquid is supplied to the gap.

According to the recording head of the invention, the moisture retention liquid is kept near the discharge port by the capillary attraction, and the moisture retention liquid becomes an evaporation source near the discharge port. Namely, the humidity near the discharge port can preferably be kept with a very simple configuration without providing the particular apparatus such as an evaporation apparatus. The drying of the liquid in the discharge port can be prevented for a long time by keeping the humidity near the discharge port in the preferable state. Further, according to the recording apparatus of the invention in which the recording head of the invention is used, the generation of the problem can be suppressed at the minimum in the discharge action, when the liquid discharge resumes after the state in which the liquid is not discharged continues.

DETAILED DESCRIPTION OF THE EMBODIMENTS

Preferred embodiments of the invention will be described below with reference to the accompanying drawings.

In the specification, "recording" should widely be interpreted rather than the formation of significant information such as characters and graphics. Particularly, there is no need for either significance or insignificance, or there is no need for whether visualization is performed such that a human can visually recognize or not, "recording" should widely mean the formation of an image, a design, a pattern, and the like on the recording medium or processing of the medium.

"Recording medium" should mean not only paper used in the general recording apparatus, but also materials, such as cloth, a plastic film, a metal plate, glass, ceramics, wood, and leather, which can receive the ink.

"Ink" or "liquid" should widely be interpreted as with the definition of the above "recording." Particularly, "ink" or "liquid" are used for the formation of the image, the design, the pattern, and the like or the processing of the recording medium by giving "ink" or "liquid" on the recording medium. Specifically, "ink" or "liquid" should mean the printing ink of the characters and the image, a material used for the formation of a wiring pattern, and the liquid which can be provided for the ink process (for example, solidification or insolubilization of a colorant in the ink given to the recording medium).

First Embodiment

Figure 8:
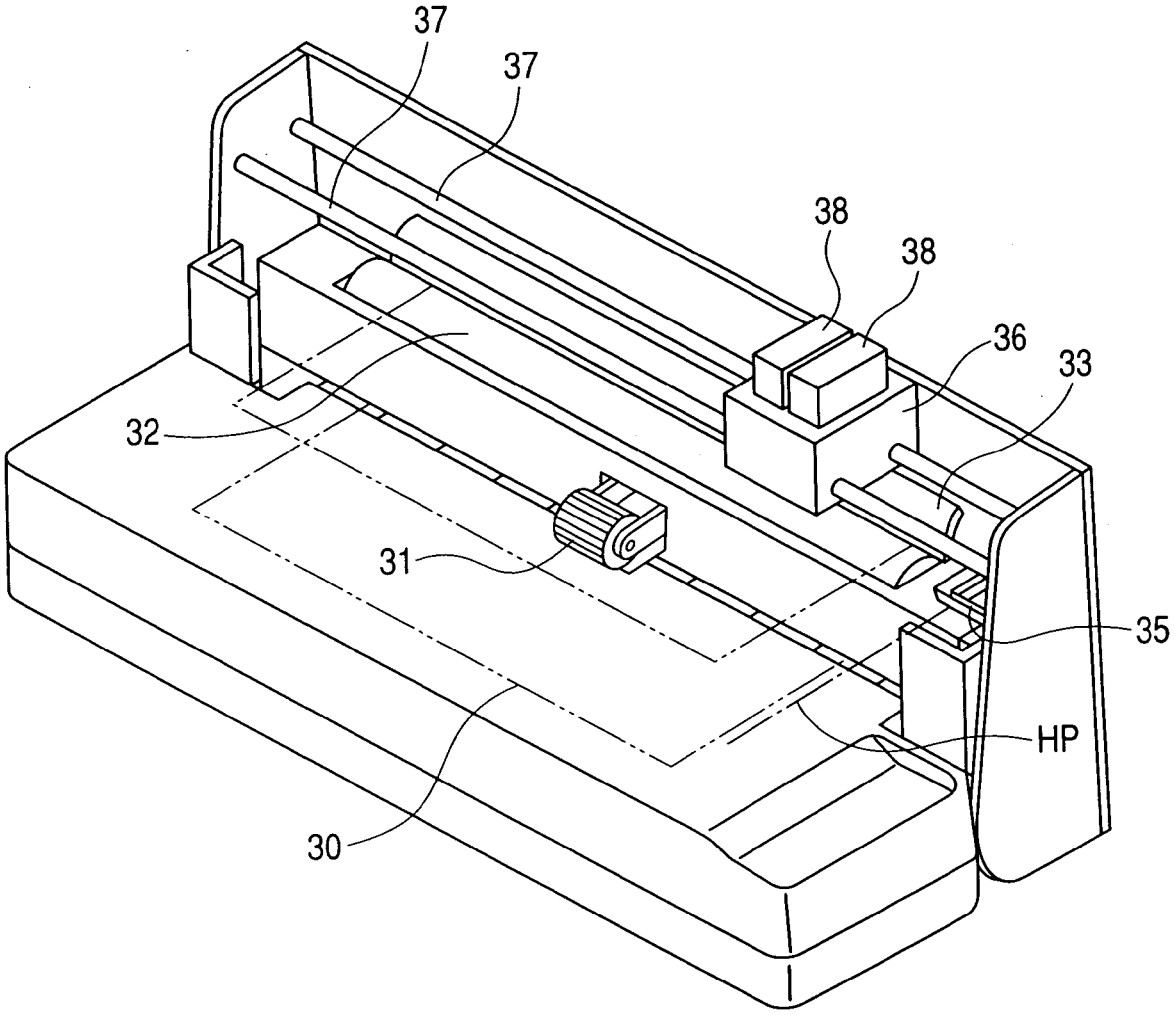
FIG. 8 is a view showing a schematic configuration of a liquid discharge recording apparatus to which the recording head of the invention is applicable.

FIG. 8 is a perspective view showing a schematic configuration of a liquid discharge recording apparatus to which a recording head according to the invention is applicable. Referring to FIG. 8, a recording head 38 which discharges the liquid such as the ink is mounted on a main scanning carriage 36 while positioned. The main scanning carriage 36 is guided and supported while being reciprocally movable along a main scanning rail 37. The main scanning carriage 36 is reciprocally driven in a main scanning direction (direction of the main scanning rail 37) by a drive source (not shown).

A recording sheet 30 such as recording paper is delivered into an apparatus main body by a sheet-feed roller 31, and the recording sheet 30 is sandwiched between a pinch roller (not shown) and a sheet pressing plate 33 on a sheet-conveying roller (conveying roller) 32. The recording sheet is conveyed through a position (recording position) which is separated from a front surface (in this case, a head surface provided in the bottom surface of the recording means) of recording means (recording head) constituted by a head 38 at a predetermined interval by controlling rotation of the sheet-conveying roller 32. The image including the characters is recorded (printed) by driving a recording head 1 based on recording information. A home position HP of the main scanning carriage 36 is set at a position (right end portion of FIG. 8) which is located outside a recording area. The position is also located within the moving range of the main scanning carriage 36.

Capping means provided with a cap made of an elastic rubber material is arranged near the home position HP. The capping means can seal the discharge port while abutting on (coming into close contact with) the head surface (surface in which the discharge port is formed) of the recording head 38. Suction means including a suction pump is also arranged. In the capping condition, the suction pump can generate negative pressure suction force in the discharge port through the cap. Further, a recording head recovery device 35 including cleaning means is arranged. The cleaning means includes a cleaning member which slides closely on the head surface of the recording head 38 to wipe deposits such as the ink and dust. The recording head recovery device 35 generates negative pressure in the cap with the suction pump while the discharge port portion of the recording head 38 is capped. The negative pressure sucks foreign matters such as viscosity-increased ink, bubble, sticking ink, and the dust along with the ink by the negative pressure to evacuate and remove the foreign matters from the discharge port. Therefore, recovery action which recovers ink discharge performance of the recording head 38 can be achieved.

Figure 1A:
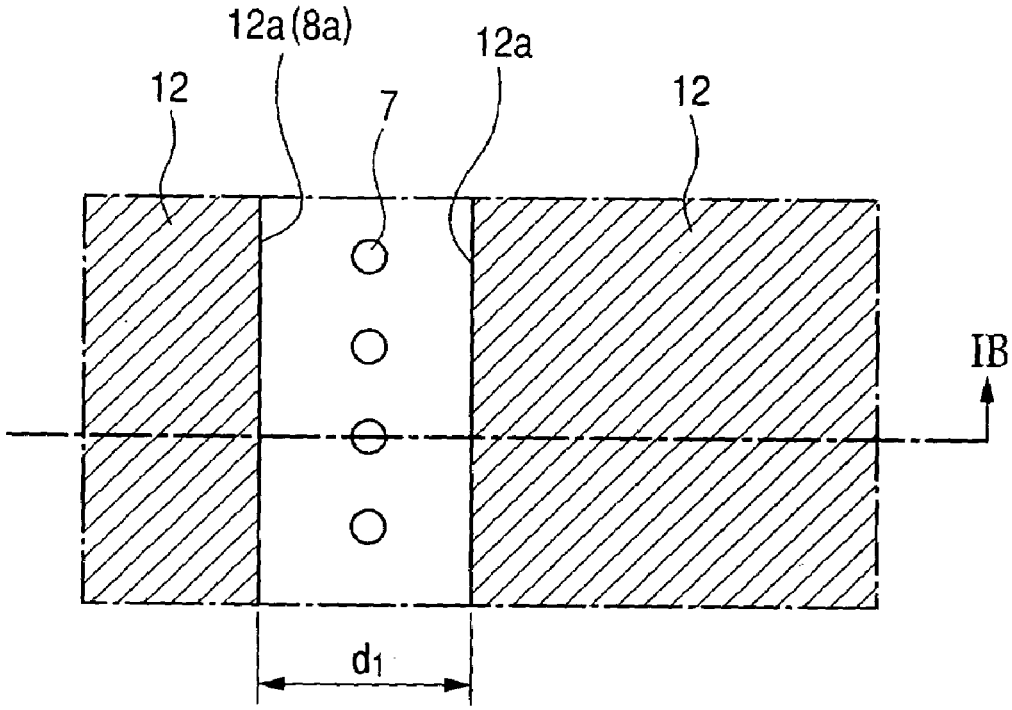
FIGS. 1A and 1B are views showing a configuration of a recording head according to a first embodiment of the invention.
Figure 1B:
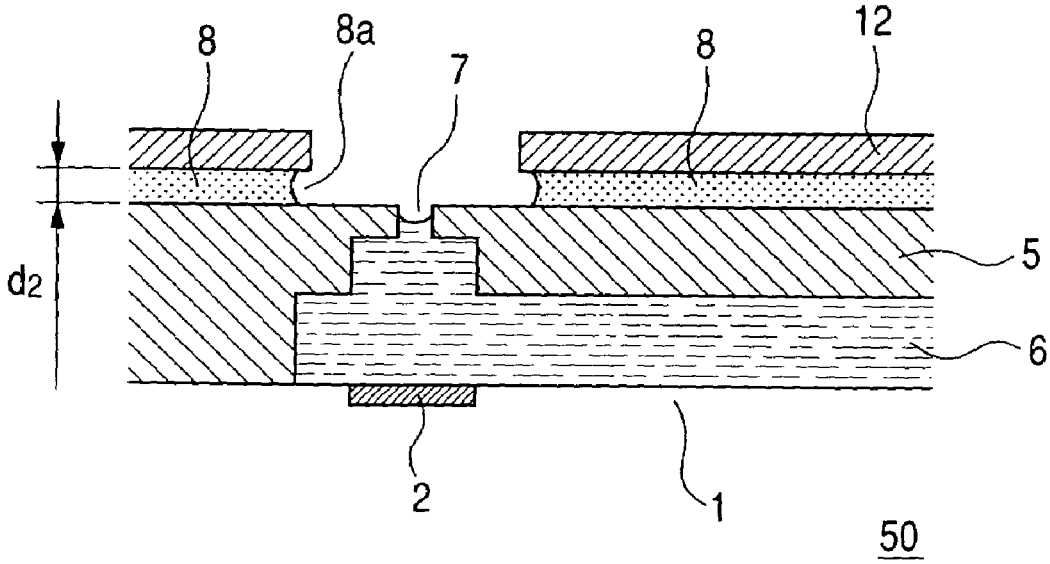

FIGS. 1A and 1B show a configuration of a recording head according to a first embodiment of the invention, FIG. 1A is a top view showing the recording head, and FIG. 1B is a sectional view taken along a line IB of FIG. 1A. The line IB is one which perpendicularly intersects both the discharge port surface and an opening portion while passing through the center of the discharge port.

A recording head 50 shown in FIG. 1B has the generally known configuration of such a kind of the recording head, except that a gap forming member 12 is arranged above channel forming member 5 (liquid discharge direction). In the recording head 50, the channel forming member 5 is arranged as an orifice plate on an element substrate 1 in which a heater 2 is formed, and a flow path (ink channel) 6 is formed between the element substrate 1 and the channel forming member 5. A heater 2 is formed in the ink channel 6. The heater 2 generates the bubble by giving the thermal energy to the liquid such as the ink, which discharges the ink. A part of the ink channel 6, where the heater 2 is formed, functions as a pressure chamber. In the surface (discharge port surface) of the channel forming member 5, a discharge port 7 is formed at a position corresponding to the heater 2. As shown in FIG. 1A, the plural discharge ports 7 are formed in line at predetermined intervals. Namely, one discharge port row is formed by the plural discharge ports 7. Although the one discharge port row is formed in the first embodiment, the invention can also be applied to the recording head in which at least two discharge port rows are formed.

Then, the gap forming member 12 and its peripheral structure will be described.

One gap forming member 12 is formed by a flat plate member, and the gap forming member 12 is arranged on each of the both sides of the discharge port row. As shown in FIG. 1A, a discharge port side-end portion 12*a* of the gap forming member 12 is parallel to the discharge port row while separated from the discharge port row by a predetermined distance. In the first embodiment, the peripheral structure of the gap forming member 12 has a symmetrical shape with respect to the discharge port row. As shown in FIG. 1B, the gap forming member 12 is arranged while separated from the discharge port surface (upper surface) by a constant interval (gap).

Thus, the arrangement of the gap forming member 12 makes a moisture retention liquid retention portion 8 between the gap forming member 12 and the channel forming member 5. The moisture retention liquid keeping portion 8, which is formed as a flattened gap portion, keeps moisture retention liquid. The moisture retention liquid keeping portion 8 has an opening portion 8*a* which is opened toward the discharge port 7 side, and the opening portion 8*a* is formed in parallel with the discharge port row. More specifically, however only a part of the opening portion 8*a* is shown in FIG. 1A, the opening portion 8*a* is formed in the long shape in the range in which the opening portion 8*a* is opened for all the discharge ports 7 formed. Therefore, the moisture retention can substantially evenly be performed for the periphery of the discharge port 7.

Although a structure which supports the gap forming member 12 is not shown in FIG. 1A and 1B, for example, it is possible that an end portion of the gap forming member 12, which is located on the side opposite from the discharge port 7, is supported by a support member (not shown). Alternatively, it is possible that the gap forming member 12 is supported by providing a rib or a boss between the gap forming member 12 and the channel forming member 5. Therefore, the gap forming member 12 is supported more stably, and mechanical strength is also improved. When the structural stability of the gap forming member 12 is improved by providing the rib or the boss, it is desirable that the provision of the rib or the boss decreases a volume of the moisture retention liquid keeping portion 8 too much.

As shown in FIG. 1B, during the use of the recording head 50, the moisture retention liquid is kept in the moisture retention liquid keeping portion 8. Any kind of the liquid can be used as the moisture retention liquid as long as the liquid can moisturize the periphery of the discharge port 7 by evaporation. For example, the same liquid as the discharged liquid can be used as the moisture retention liquid, and the ink, water, or the ink in which dye is removed can also be used.

Then, the dimension of each portion in the recording head which is applicable to the invention will be described.

Figure 9:
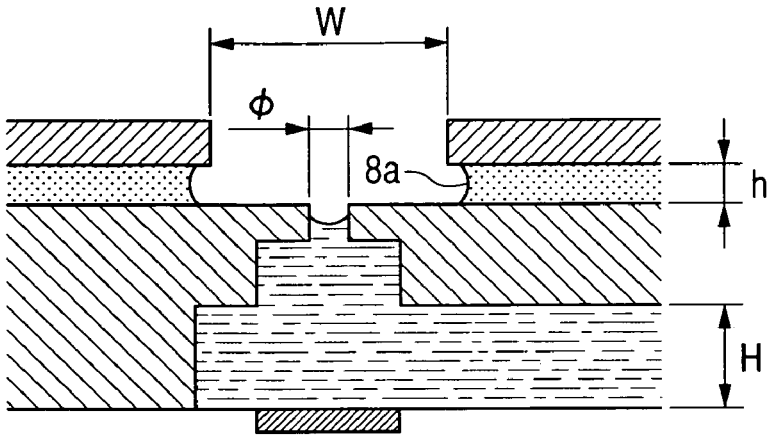
FIG. 9 is an enlarged view showing a periphery of a discharge port in the first and second embodiments of the invention.

As shown in FIG. 9, it is assumed that a height (distance between the discharge port surface and the gap forming member) of the moisture retention liquid keeping portion is set at h, a diameter of the discharge port is set at $\phi$, and an interval between the moisture retention liquid keeping portions which are provided on both sides across the discharge port is set at W.

Because an amount of evaporation depends on an area of a liquid surface, it is required that an opening area of the discharge port is not more than an opening area of the opening portion 8*a* of the moisture retention liquid keeping portion. In order to further enhance the moisture retention effect, it is preferable that "the diameter $\phi$ of the discharge port is not more than the height h of the moisture retention liquid keeping portion". The diameter $\phi$ of the discharge port is set by a size of the liquid to be discharged. When a discharged droplet is about 0.5 pl, the diameter $\phi$ becomes about 6 μm. When the discharged droplet is about 2 pl, the diameter $\phi$ is in the range from about 10.5 μm to about 12 μm. When the discharged droplet is about 5 pl, the diameter $\phi$ becomes about 16 μm.

It is also possible that a production process is simplified by causing the height h of the moisture retention liquid keeping portion to coincide with a height H of the ink channel 6. Generally the height H of the ink channel ranges from about 10 μm to about 20 μm.

Then, the interval W between the moisture retention liquid keeping portions arranged on the both sides across the discharge port will be described.

When the interval W becomes larger, the opening portion 8*a* having the moisture retention liquid is separated away from the discharge port, which decreases the moisture retention effect. When the ratio of moisture in atmosphere in proximity of discharge port which moisture is derived from that the moisture retention liquid evaporates and diffuses is substantially equal to the ratio of moisture in atmosphere in proximity of the discharge port which moisture is evaporated from the discharge port in case where the moisture retention liquid is not present. For example, assuming that the diameter $\phi$ of the discharge port is 6 μm and the height h of the moisture retention liquid keeping portion is 1000 μm, the moisture retention effect with a degree to which the discharge failure is improved can be obtained when the interval W is not more than 300 μm. When the interval W is not more than 100 μm, the evaporation can ideally be suppressed. Because generally the discharge failure caused by the drying becomes prominent as the diameter of the discharge port is decreased, it is preferable that the moisture retention liquid keeping portion corresponding to the small discharge port is located near the discharge port.

Figure 10A:
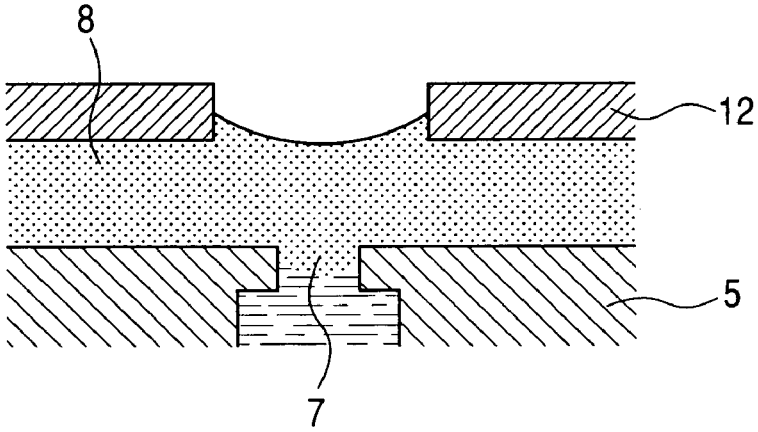
FIG. 10A is a view showing a state in which discharge liquid and the moisture retention liquid are mixed with and connected to each other.
Figure 10B:
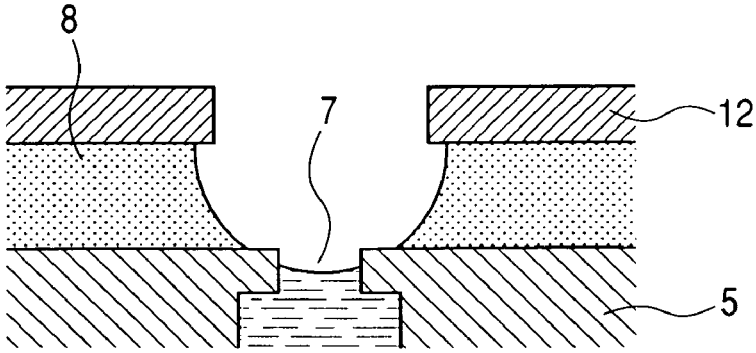
FIG. 10B is a view showing a state in which the discharge liquid and the moisture retention liquid are not connected to each other.

When the interval W is too narrowed, as shown in FIG. 10A, there is a possibility that the moisture retention liquid and the discharge liquid are coupled to each other. It is also related with tank pressure (the negative pressure) under which the discharge liquid is kept. Therefore, as shown in FIG. 10B, the configuration of the recording head in which the moisture retention liquid and the discharge liquid are not coupled to each other will be described.

Figure 11:
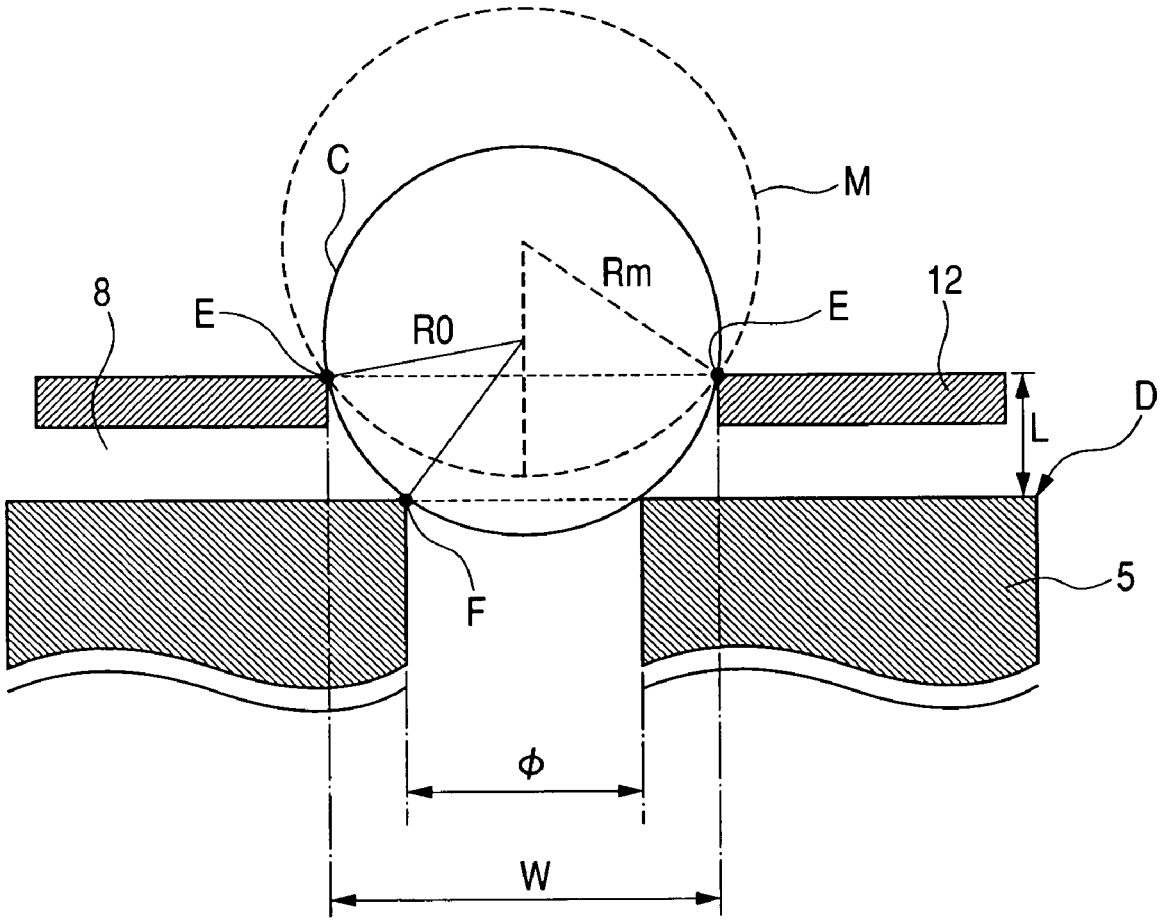
FIG. 11 is an enlarged view showing the discharge port and a periphery of an opening portion of a gap forming portion.

FIG. 11 is an enlarged view showing the moisture retention liquid keeping portion and the periphery of the discharge port.

It is assumed that an end portion of the surface (surface facing the recording medium) of the gap forming member 12 is E and an end portion of the discharge port formed in a discharge port surface D of the channel forming member 5 is F. Due to the sectional view, the end portions E and F are shown as a point respectively. It is assumed that a circle having a radius R0 which passes through the points E and F is C and a distance between the discharge port surface D and the surface of the gap forming member 12 is L. The distance L is one in which a thickness of the gap forming member is added to the height h of the moisture retention liquid keeping portion.

It is assumed that a circle which passes through the point E and indicates the liquid level is M and a radius of the circle M is Rm. In case where the negative pressure in the tank is low, when ink in the nozzle is suctioned, the liquid level is separated from the point F, which allows the moisture retention liquid and the ink to be coupled to each other. At this point, the radius Rm of the circle M is larger than the radius of the circle C. On the other hand, when a negative pressure in the tank is high, the radius Rm of the circle M becomes small to be close to the radius of circle C. Further, when the negative pressure in the tank becomes higher, the radius Rm of circle M becomes smaller than the radius of circle C. At this time, the shape shown in FIG. 10B can be held while the moisture retention liquid surface and the ink liquid level are not coupled to each other.

Thus, the following expression (1) can be obtained:

$$Rm<R0 \quad (1)$$

Pressure P which is of the pressure (a force exerted from ink), derived from the negative pressure in the tank, applied to the meniscus shown by the above-mentioned circle M is obtained by the following expression (2):

$$P=(\gamma/Rm) \quad (2)$$

where γ is surface tension of the liquid such as the discharged ink.

The following expression (3) is obtained from the expressions (1) and (2):

$$(\gamma/P)<R0 \quad (3)$$

where R0 is determined by the diameter ϕ of the discharge port, the interval W of the moisture retention liquid keeping portions arranged on the both sides across the discharge port, and the distance L in which the thickness of the gap forming member is added to the height h of the moisture retention liquid keeping portion as shown in FIG. 11. Accordingly, as shown in FIG. 10B, the moisture retention liquid and the liquid such as the discharged ink can be held while being not coupled to each other by using the recording head, the ink, and the tank having the configurations of the diameter ϕ, the interval W, and the distance L which satisfy the expression (3).

According to the recording head having the above configuration, the moisture retention liquid keeping portion which keeps the moisture retention liquid for moisturizing the periphery of the discharge port is formed as the gap portion between the gap forming member arranged above the discharge port surface and the discharge port surface. The appropriate change in dimension of the gap forming member can form the moisture retention liquid keeping portion which can keep a large amount of moisture retention liquid. Accordingly, the advantage that the large amount of moisture retention liquid can be kept in the moisture retention liquid keeping portion enables the moisture retention in the periphery of the discharge port for a long time.

Methods of supplying the moisture retention liquid to the moisture retention liquid keeping portion 8 will be described below.

(1) Method with Suction Recovery Mechanism of Recording Apparatus

Figure 4A:
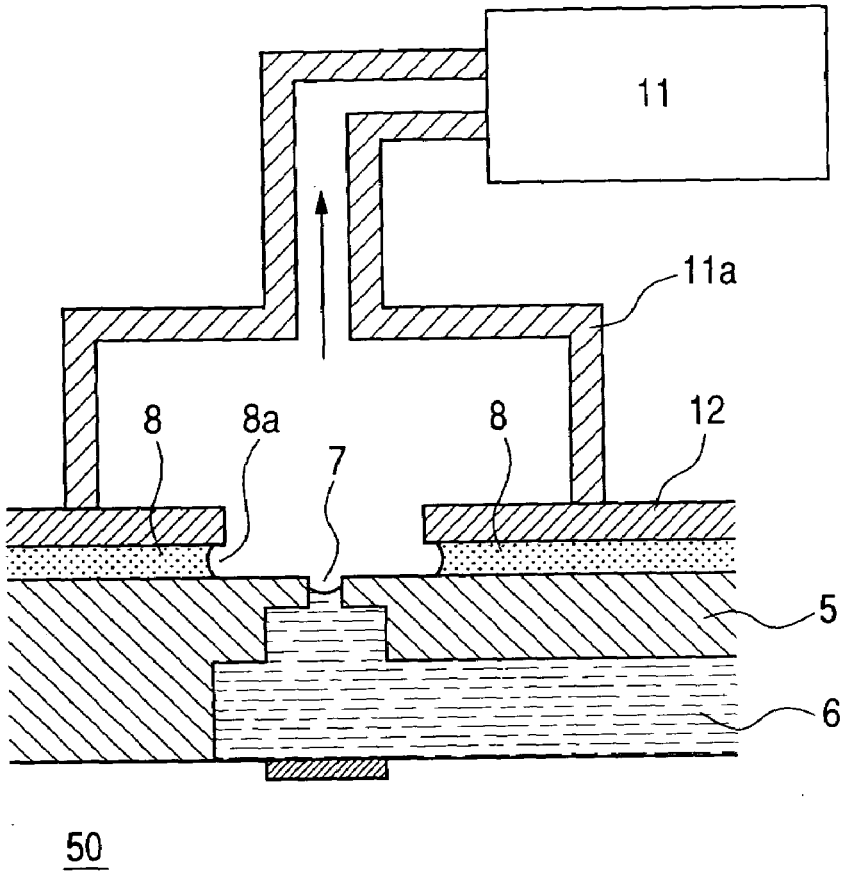
FIG. 4A is a schematic view showing a case in which a suction and recovery mechanism is used as moisture retention liquid supplying means.

When the recording apparatus includes a suction recovery mechanism 11 as shown in FIG. 4A, the ink can be kept as the moisture retention liquid in the moisture retention liquid keeping portion 8 of the recording head 50 by utilizing the suction recovery mechanism 11. With reference to the action of the suction recovery mechanism 11, a cap 11*a* of the suction recovery mechanism 11 is caused to abut on the surface side of the recording head 50. Particularly, the cap 11*a* abuts on the surface (surface facing the recording medium) of the gap forming member 12 in the recording head 50, and the cap 11*a* is formed such that at least a region where the discharge port 7 is formed and the opening portion 8*a* of the moisture retention liquid keeping portion 8 are covered therewith in the recording head 50. The ink is forcedly sucked from the discharge port 7 by driving the pump of the suction recovery mechanism 11. The pump is connected to the cap 11*a*. In the recovery action, the ink overflowing from the discharge port 7 is kept within a space formed between the gap forming member 12 and the cap 11*a*. Therefore, the overflowing ink is drawn into the moisture retention liquid keeping portion 8 by capillary attraction, which allows the ink to be kept as the moisture retention liquid in the moisture retention liquid keeping portion 8.

Figure 4B:
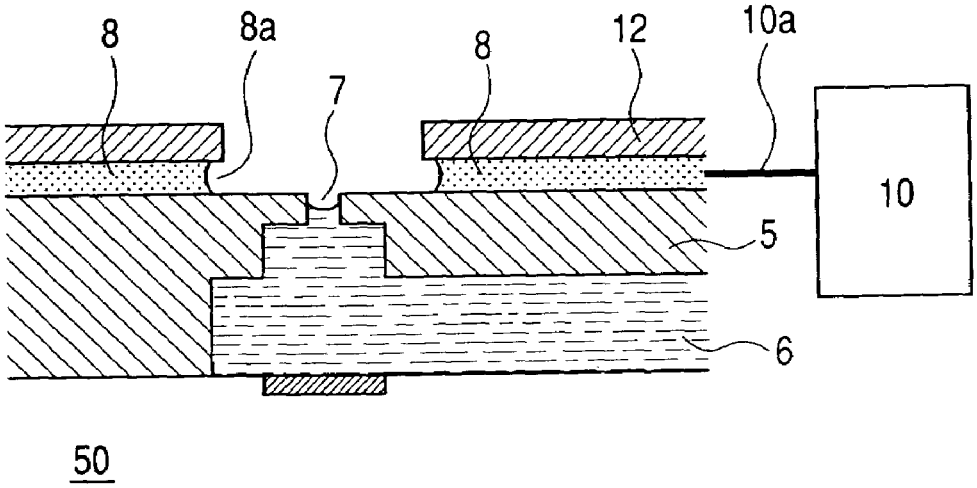
FIG. 4B is a schematic view showing a state in which a moisture retention liquid supplying mechanism is used as the moisture retention liquid supplying means.
Figure 5A:
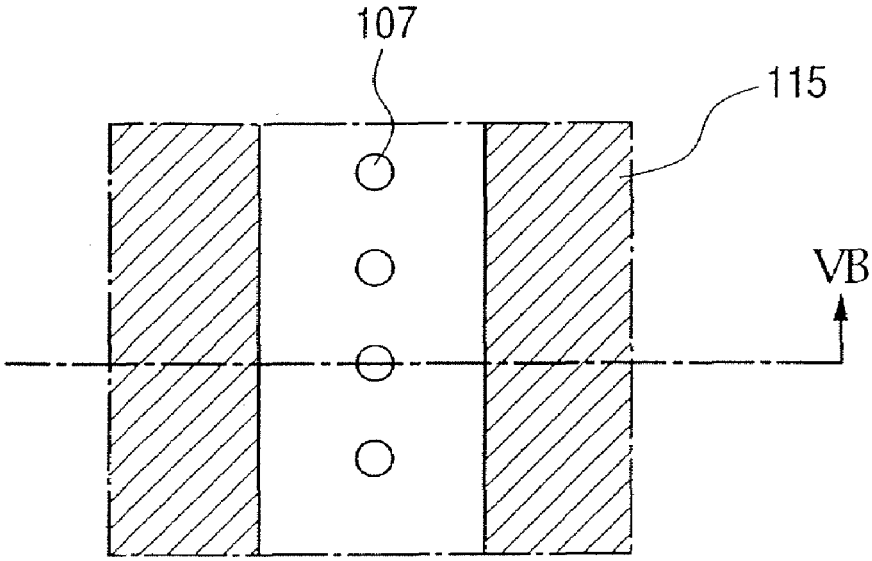
FIG. 5A PRIOR ART
FIGS. 5A and 5B are views showing a configuration of the conventional recording head.
Figure 5B:
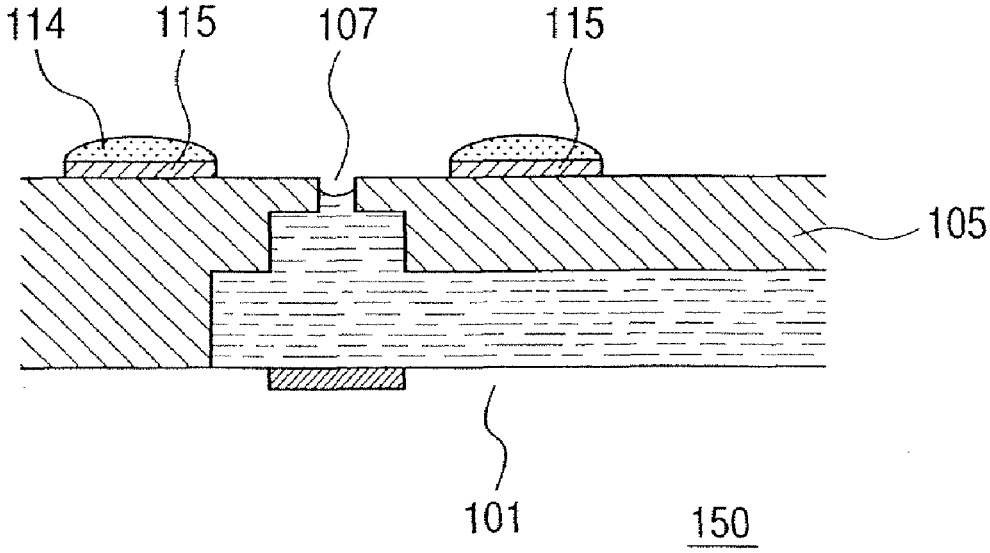
FIG. 5B PRIOR ART

(2) Method with Moisture Retention Liquid Supplying Mechanism Provided in Recording Apparatus As shown in FIG. 4B, a moisture retention liquid supply mechanism 10 is newly provided in the recording apparatus, and the moisture retention liquid is supplied into the moisture retention liquid keeping portion 8 by the moisture retention liquid supply mechanism 10.

An example of the moisture retention liquid supply mechanism can be cited as follows. Namely, the moisture retention liquid supply mechanism includes a reserve vessel in which the moisture retention liquid containing the ink in which the water and the dye are removed is stored, a passage member (for example, a pipe member 10*a* such as a tube) which transports the moisture retention liquid in the reserve vessel to the moisture retention liquid keeping portion 8, and a pump provided in the midstream of the passage member. In this case, in the configuration shown in FIGS. 1A and 1B, it is possible that a connection portion is formed in the end portion on the side opposite from the discharge port 7 of the moisture retention liquid keeping portion 8 and the passage member is connected to the connection portion. It is also possible that a sensor which detects the amount of moisture retention liquid remaining in the moisture retention liquid keeping portion 8 is provided and utilized.

The moisture retention liquid supply mechanism having the above configuration is driven at predetermined timing in which the amount of moisture retention liquid remaining is low in the moisture retention liquid keeping portion 8. Namely, the moisture retention liquid in the reserve vessel is supplied into the moisture retention liquid keeping portion 8 through the passage member by driving the pump of the moisture retention liquid supply mechanism 10.

Since the suction recovery mechanism incorporated in the recording apparatus is used in the method (1), the method (1) has the advantage in that the particular supply mechanism is not required unlike the method (2). Since the moisture retention liquid in the reserve vessel is supplied in the method (2), the method (2) has the advantage in that various kinds of the moisture retention liquid suitable for the moisture retention can be used in addition to the ink.

Figure 6A:
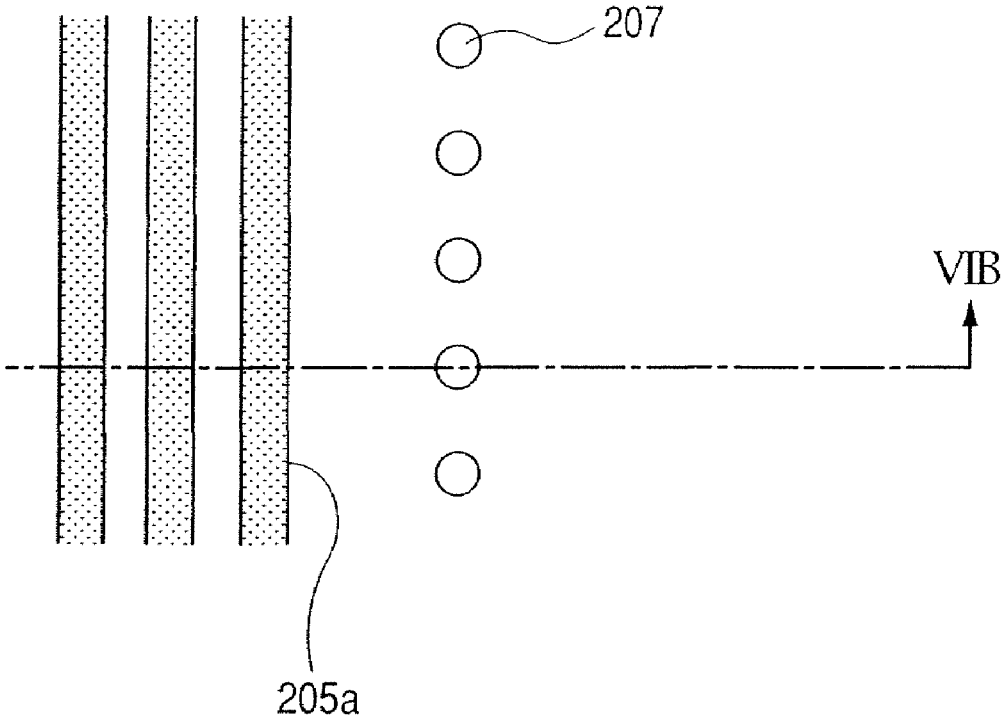
FIG. 6A PRIOR ART
FIGS. 6A and 6B are views showing another configuration of the conventional recording head.
Figure 6B:
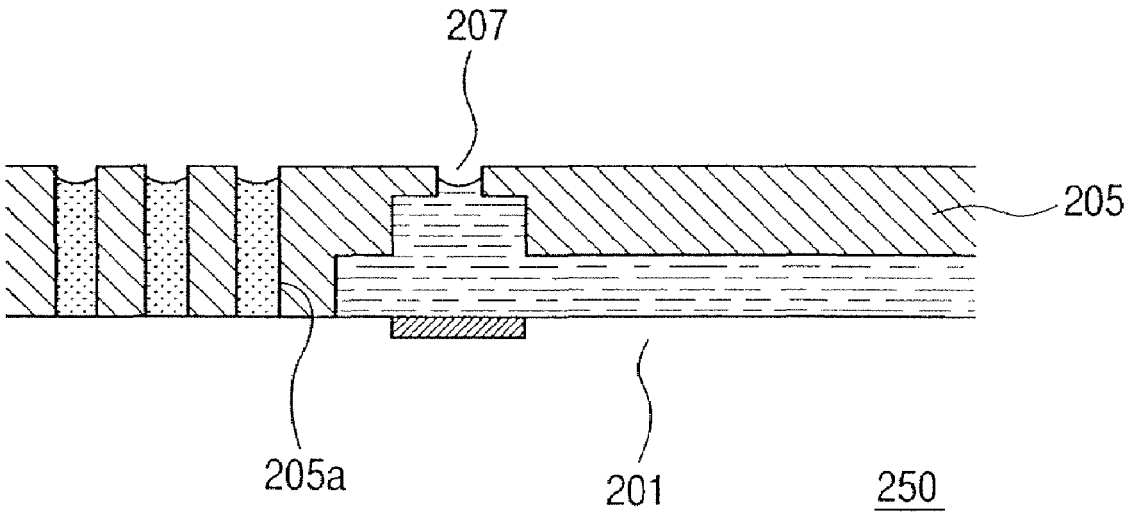
FIG. 6B PRIOR ART

As described above, according to the recording head 50 of the fist embodiment, the moisture retention liquid keeping portion 8 is formed between the gap forming member 12 and the surface (discharge port surface) of the channel forming member 5. Since the volume of the moisture retention liquid keeping portion 8 becomes larger for example when compared with the conventional configuration shown in FIGS. 6A and 6B, the larger amount of moisture retention liquid can be kept in the moisture retention liquid keeping portion 8, which allows the moisture retention to be performed in the periphery of the discharge port 7 for longer time. The moisture retention liquid keeping portion 8 is formed in the flat shape, and the moisture retention liquid is stably kept by the capillary attraction between the gap forming member 12 and the channel forming member 5. The opening portion 8*a* of the moisture retention liquid keeping portion 8 is opened in the horizontal direction (direction parallel to the discharge port surface) while faced toward the discharge port 7 side. As a result, when compared with the conventional configuration in which the liquid keeping groove is opened toward the direction (upward direction) perpendicular to the discharge port surface as shown in FIGS. 6A and 6B, the periphery of the discharge port 7 can be moisturized more effectively. The opening portion 8*a* is formed in long so as to be opened for all the discharge ports 7, and the distance between each discharge port 7 and the opening portion 8*a* is kept constant.

Therefore, all the discharge ports 7 can substantially evenly be moisturized.

The various modifications can be made in the configuration of the recording head 50. For example, in order to supply the ink into the moisture retention liquid keeping portion 8, it is possible that the moisture retention liquid keeping portion 8 and a common liquid chamber (not shown) of the recording head 50 are communicated with each other. Further, in order to supply the ink into the moisture retention liquid keeping portion 8, it is possible that the moisture retention liquid keeping portion 8 and the ink tank of the recording apparatus are communicated with each other. At this point, the common liquid chamber means a structure, which is formed in the element substrate 1 and stores the ink supplied to the ink channels 6.

Second Embodiment

The descriptions on the structure of the apparatus and the like, which are similar to the first embodiment, will be omitted.

Figure 2A:
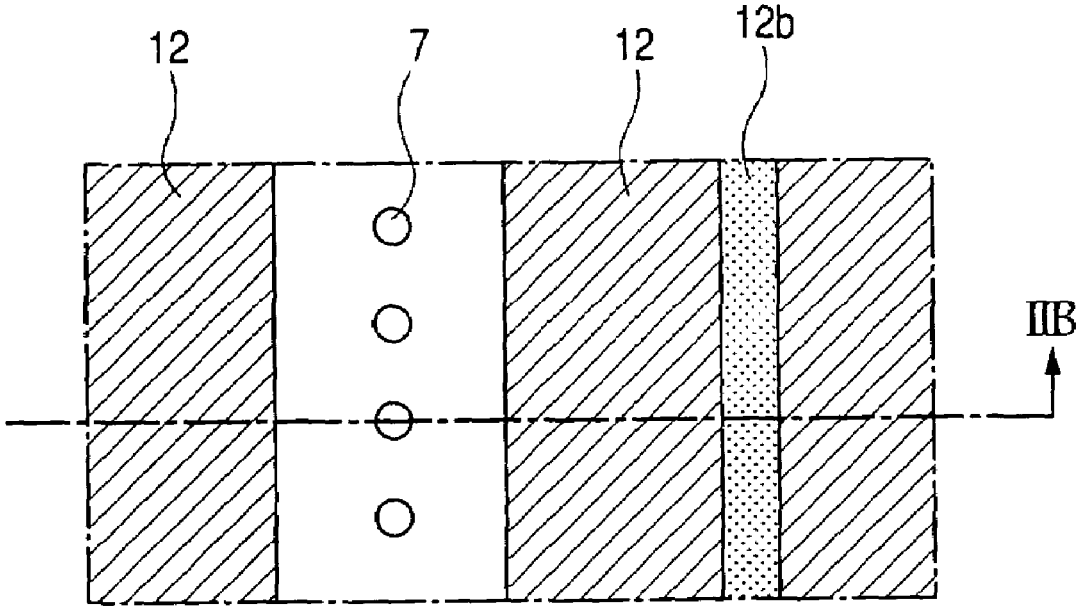
FIGS. 2A and 2B are views showing a configuration of a recording head according to a second embodiment of the invention.
Figure 2B:
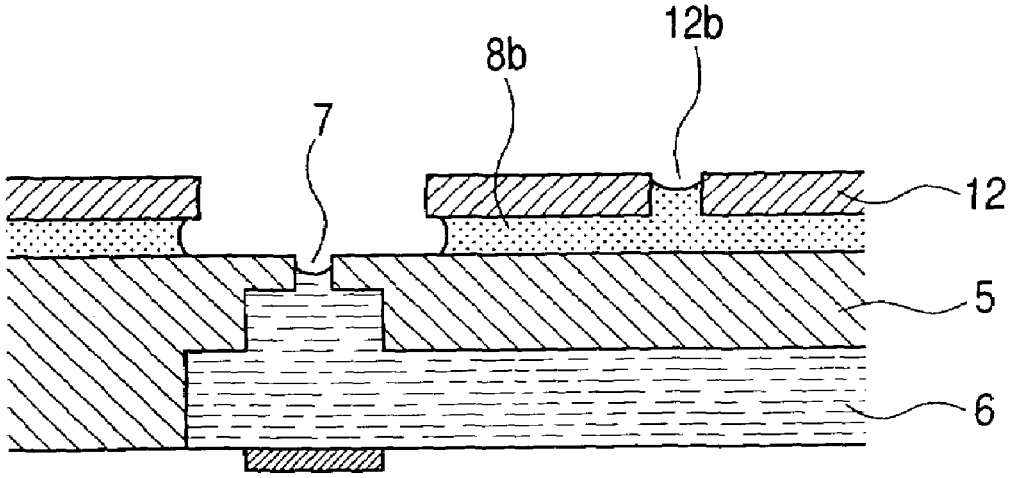

FIGS. 2A and 2B show configurations of a recording head according to a second embodiment of the invention. FIG. 2A is a top view of the recording head, and FIG. 2B is a sectional view taken along a line IIB of FIG. 2A.

A recording head 51 shown in FIG. 2B further has a communication port 12*b* formed in the gap forming member 12 in addition to the configuration of the recording head 50 shown in FIG. 1B. In other structures, the recording head 51 is similar to the recording head 50. Therefore, in the recording head 51, the same structure as for the recording head 50 is indicated by the same reference numeral, and the description will be omitted.

The communication port 12*b* is formed while piecing through the gap forming member 12. As shown in the top view of FIG. 2A, the communication port 12*b* is formed so as to become one long hole. Since the communication port 12*b* is formed in the above manner, while a moisture retention liquid keeping portion 8*b* is not only partially opened toward the discharge port 7 side, but also partially opened toward the surface of the gap forming member 12. FIG. 2B shows the state in which the moisture retention liquid is kept in the moisture retention liquid keeping portion 8*b*.

Thus, according to the recording head 51 of the second embodiment, the moisture retention liquid in the moisture retention liquid keeping portion 8*b* can be evacuated through the communication port 12*b* by the suction of the moisture retention liquid. Therefore, the recording head 51 has the advantage that exchange of the moisture retention liquid is facilitated in the moisture retention liquid keeping portion 8*b*.

For example, it is possible that the exchange action is performed with the suction recovery mechanism as follows. In this case, the moisture retention liquid is the ink. First the cap of the suction recovery mechanism is caused to abut on the surface side of the recording head 51. When the pump is driven, the ink is forcedly sucked from the discharge port 7, and the ink in the moisture retention liquid keeping portion 8*b* is also sucked through the communication port 12*b*. Accordingly, while the old ink kept in the moisture retention liquid keeping portion 8*b* is evacuated, the ink overflowing from the discharge port 7 is drawn into the moisture retention liquid keeping portion 8*b* by the suction action. Thus, the moisture retention liquid (ink) is exchanged in the moisture retention liquid keeping portion 8*b*.

In the case where the ink is used as the moisture retention liquid, since the moisture in the ink kept in the moisture retention liquid keeping portion 8*b* evaporates with the passage of time, the performance of the ink is gradually decreased as the moisture retention liquid in the moisture retention liquid keeping portion 8*b*. In order to take the countermeasure against the above problem, the second embodiment is configured to easily exchange the ink in the moisture retention liquid keeping portion 8*b*. Therefore, the second embodiment has the advantage in that the ink having the high moisture content can be kept in the moisture retention liquid keeping portion 8*b*.

Figure 3A:
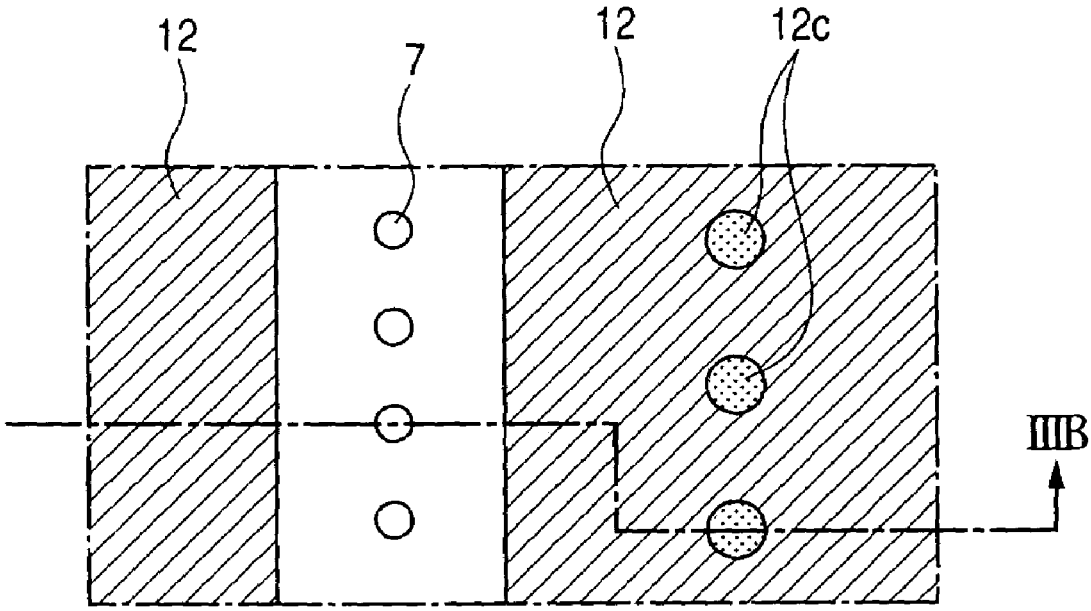
FIGS. 3A and 3B are views showing a configuration of another recording head according to the second embodiment.
Figure 3B:
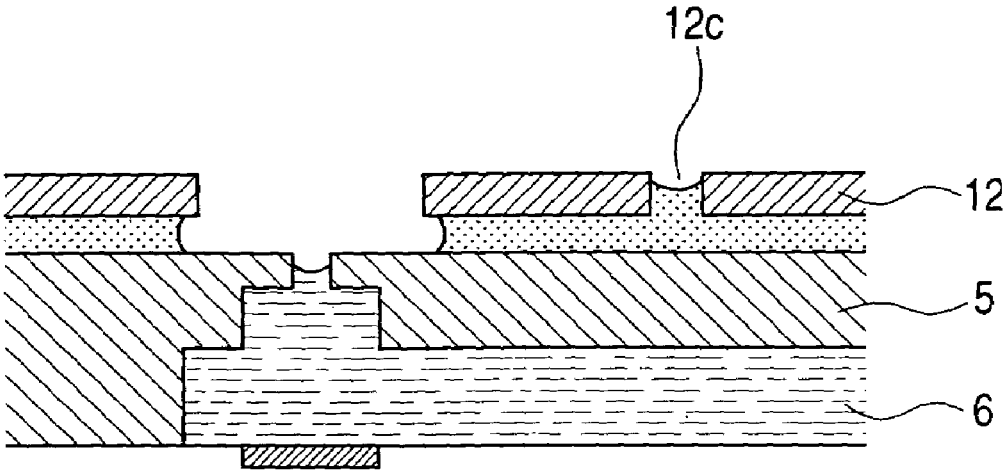

The various modifications can be made in the shape of the communication port 12*b* provided in the gap forming member 12. For example, it is possible that the shape of the communication port 12*b* is formed as shown in FIGS. 3A and 3B. FIG. 3A is a top view of the recording head, and FIG. 3B is a sectional view taken along a line 111B of FIG. 3A.

In a recording head 52 shown in FIG. 3B, communication ports 12*c* are independently provided while formed in a through-hole. The total opening area of the communication ports 12*c* is smaller than the opening area of communication port 12*b* of FIGS. 2A and 2B. According to the recording head 52 having the above configuration, in addition to the advantage of the recording head 51, there is also obtained the advantage that the amount of evaporation of the ink from the communication ports 12*c* can be suppressed by decreasing the total opening area of the communication ports 12*c*. This means that the useless evaporation of the ink can be suppressed at the minimum to moisturize the periphery of the discharge port 7 for a long time.

Third Embodiment

The descriptions on the structure of the apparatus and the like, which are similar to the first embodiment, will be omitted.

Figure 7:
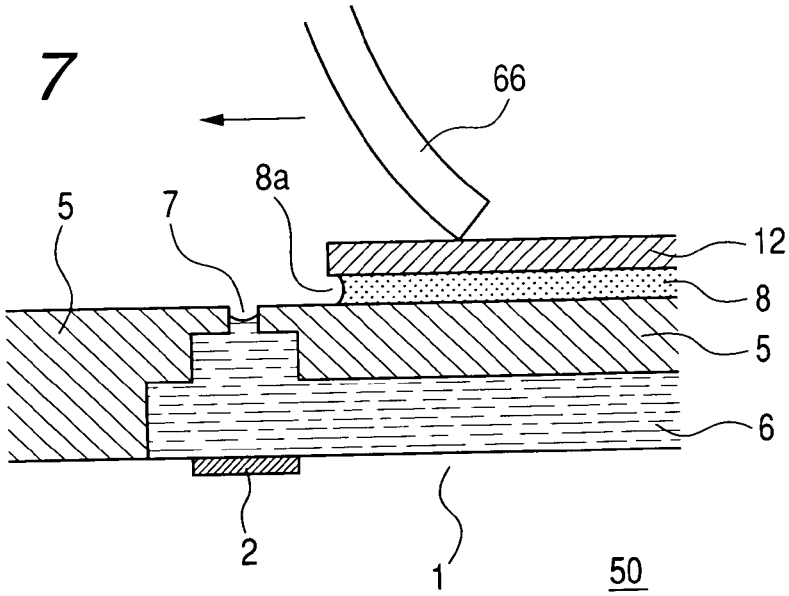
FIG. 7 is a view showing a configuration of a recording head according to a third embodiment of the invention.

In the recording head 50 of the first embodiment, the two moisture retention liquid keeping portions 8 are formed on the both sides across the discharge port 7. However, the invention is not limited to the first embodiment. For example, it is possible that the moisture retention liquid keeping portion 8 is formed on one side. FIG. 7 shows an example of the moisture retention liquid keeping portion 8 which is formed on one side. In this case, the advantage is obtained when the surface side of the recording head 50 is wiped with the wiping member formed by the elastic rubber member 66.

Namely, the case in which the wiping member wipes the surface of the recording head 50 by the horizontal movement in FIGS. 1A and 1B will be described.

The wiping member is moved from one side where the moisture retention liquid keeping portion 8 is formed to the other side (arrow direction of FIG. 7) where the moisture retention liquid keeping portion 8 is not formed. The wiping member wipes the surface of the gap forming member 12, and then the wipes the surface (discharge port surface) of the channel forming member 5 after the wiping member goes beyond the opening portion 8*a* of the gap forming member 12.

Therefore, the discharge port 7 and its periphery are kept in the clean state. Thus, when the moisture retention liquid keeping portion 8 is formed only on one side, even if the recording head has the moisture retention liquid keeping portion 8, the good wiping can be performed to the discharge port surface of the recording head.

In the conventional configuration shown in FIGS. 5A, 5B, 6A and 6B, even the moisture retention liquid is collected by the wiping. Further, there is the possibility that the upper-end opening portion of the liquid keeping groove 205*a* is clogged with the dust by the wiping (See FIGS. 6A and 6B). However, the moisture retention liquid keeping portion 8 has the configuration which is hardly affected by the wiping.

This application claims priority from Japanese Patent Application No. 2004-245370 filed Aug. 25, 2004, which is hereby incorporated by reference herein.

What is claimed is:

1. A recording head comprising:

an energy generating element which generates energy utilized in order to discharge liquid;

a channel forming member which has a discharge port surface, a discharge port which discharges the liquid being provided in the discharge port surface, and the channel forming member being communicated with the discharge port; and a gap forming member which faces the discharge port surface, the gap forming member being arranged such that a gap is provided between the discharge port surface and the gap forming member except at a position corresponding to the discharge port, wherein an opening portion which is opened at a discharge port side of said gap forming member is formed for said gap forming member, the gap retains moisture retention liquid, and a liquid surface of the moisture retention liquid is formed at the opening portion.

2. A recording head according to claim 1, further comprising a discharge port row including a plurality of discharge ports, wherein the opening portion is formed lengthwise in parallel with the discharge port row.

3. A recording head according to claim 2, wherein opening portions are positioned on both sides of the discharge port row, the opening portions facing each other.

4. A recording head according to claim 1, wherein a communication port piercing through the gap forming member is formed in the gap forming member, and the gap is communicated with a surface side of the gap forming member through the communication port.

5. A recording head according to claim 1, wherein an opening area of the opening portion is larger than that of the discharge port.

6. A recording head according to claim 5, wherein a distance between the discharge port surface and the gap forming member is larger than a diameter of the discharge port.

7. A recording apparatus which has a tank keeping the liquid, wherein the recording apparatus performs recording on a print medium using a recording head according to claim 1.

8. A recording apparatus according to claim 7, wherein the following expression is satisfied for a cross-section taken along a plane perpendicularly intersecting both the discharge port surface and the opening portion and passing through the center of the discharge port:

$$(\gamma/P)<R0$$

where R0 is a radius of a circle passing through both an end portion on a surface side of the gap forming member and an end portion of the discharge port, P is pressure applied to a meniscus in said discharge port and γ is surface tension of the liquid.

9. A recording apparatus according to claim 7, further comprising moisture retention liquid supplying means for supplying the moisture retention liquid to the gap.

10. A recording apparatus according to claim 9, wherein the moisture retention liquid supplying means includes head recovery means having a cap, the cap being formed such that the discharge port and the opening portion are covered therewith.

11. A recording apparatus according to claim 7, wherein said gap forming member is formed at one side of a discharge port row, constituted by a plurality of discharge ports, and in parallel with the discharge port row, wherein means is provided for moving a wiping member for wiping a surface of said gap forming member and surfaces of said discharge ports from the one side of the discharge port row where said gap forming member is formed to the other side of said discharge port row where said gap forming member is not formed.

* * * * *

UNITED STATES PATENT AND TRADEMARK OFFICE

CERTIFICATE OF CORRECTION

PATENT NO. : 7,246,873 B2
APPLICATION NO. : 11/202103
DATED : July 24, 2007
INVENTOR(S) : Tsuchii It is certified that error appears in the above-identified patent and that said Letters Patent is hereby corrected as shown below:

ON THE TITLE PAGE:
At Item (56), References Cited, Foreign Patent Documents, "2001018408" should read --2001-018408--, and "2001158106" should read --2001-158106--.

COLUMN 1:
Line 58, "while" should read --while being--.

COLUMN 2:
Line 42, "the sight" should read --a slight--.

COLUMN 5:
Line 36, "both" should read --two--.
Line 55, "however" should read --however,--.
Line 56, "in the" should be deleted.
Line 57, "long shape" should read --lengthwise--.

COLUMN 6:
Line 46, "both" should read --two--.

COLUMN 9:
Line 40, "in long" should read --lengthwise--.
Lines 43 and 44 should be merged in a single paragraph.

COLUMN 10:
Line 11, "while piecing" should read --by piercing--.

Signed and Sealed this

Seventeenth Day of February, 2009

John Doll

JOHN DOLL
*Acting Director of the United States Patent and Trademark Office*